US007766186B1

(12) United States Patent
Brown

(10) Patent No.: US 7,766,186 B1
(45) Date of Patent: Aug. 3, 2010

(54) REFUSE CONTAINER SYSTEM

(76) Inventor: Wallace E. Brown, 5504 NW. 86th Ct., Kansas City, MO (US) 64154

( * ) Notice: Subject to any disclaimer, the term of this patent is extended or adjusted under 35 U.S.C. 154(b) by 450 days.

(21) Appl. No.: 11/620,463

(22) Filed: Jan. 5, 2007

(51) Int. Cl.
*B65D 25/10* (2006.01)
*B65D 53/00* (2006.01)
*B65D 81/24* (2006.01)

(52) U.S. Cl. ..... 220/772; 220/908

(58) Field of Classification Search ..... 220/759, 220/772, 780; 16/425
See application file for complete search history.

(56) References Cited

U.S. PATENT DOCUMENTS 463,492 A * 11/1891 Dean ..... 220/532
D357,780 S 4/1995 Breen
5,547,104 A 8/1996 Parker
5,967,362 A 10/1999 Corbin
6,003,719 A * 12/1999 Stewart, III ..... 220/592.21
6,508,377 B1 * 1/2003 Griswold et al. ..... 220/495.06
6,581,796 B1 6/2003 Pilkinton
6,644,493 B1 11/2003 Walton et al.
6,808,081 B1 10/2004 Citro
7,114,631 B2 * 10/2006 Aiken et al. ..... 220/766
7,287,665 B2 * 10/2007 Meissen et al. ..... 220/766
2003/0116577 A1 6/2003 Slongo et al.
2004/0226958 A1 * 11/2004 Robellard et al. ..... 220/772
2005/0127080 A1 * 6/2005 Schutz ..... 220/759
2006/0124654 A1 * 6/2006 Cai ..... 220/780

* cited by examiner

*Primary Examiner*—Anthony Stashick
*Assistant Examiner*—Harry A Grosso

(57) ABSTRACT

A refuse container system for facilitating lifting, carrying and dispensing refuse to be disposed of includes a container having a cavity extending into the container through a top end thereof. The cavity receives refuse to be disposed of. Each of a plurality of handles is rotatably mounted to the container to permit each of the handles to be rotated to desired position. The handles are graspable to facilitate lifting of the container. A lid is positionable over the top end of the container to selectively close the top end and retain the refuse in the cavity.

10 Claims, 4 Drawing Sheets

REFUSE CONTAINER SYSTEM

BACKGROUND OF THE INVENTION

1. Field of the Invention

The present invention relates to garbage pails and more particularly pertains to a new garbage pail for facilitating lifting, carrying and dispensing refuse to be disposed of.

2. Description of the Prior Art

The use of garbage pails is known in the prior art. While these devices fulfill their respective, particular objectives and requirements, the need remains for a system that has certain improved features that allow for handle of the system to be pivoted to allow the handle to be positioned in a desired position comfortable to a person lifting the system. Additionally, the system should include a lower handle being vertically aligned with one of the other handles to allow the system to be easily carried from a side of the system.

SUMMARY OF THE INVENTION

The present invention meets the needs presented above by generally comprising a container having a cavity extending into the container through a top end thereof. The cavity receives refuse to be disposed of. Each of a plurality of handles is rotatably mounted to the container to permit each of the handles to be rotated to desired position. The handles are graspable to facilitate lifting of the container. A lid is positionable over the top end of the container to selectively close the top end and retain the refuse in the cavity.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
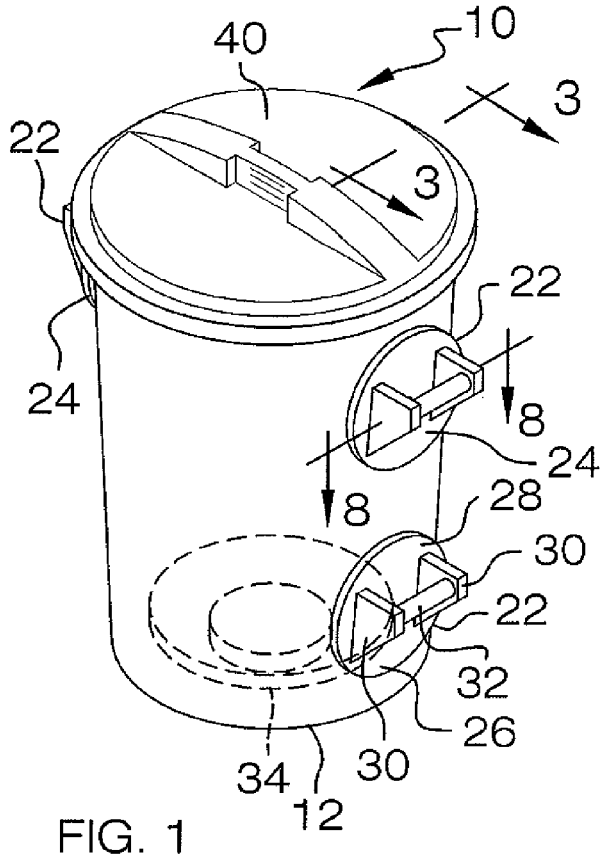
FIG. 1 is a perspective view of a refuse container system according to the present invention.
Figure 2:
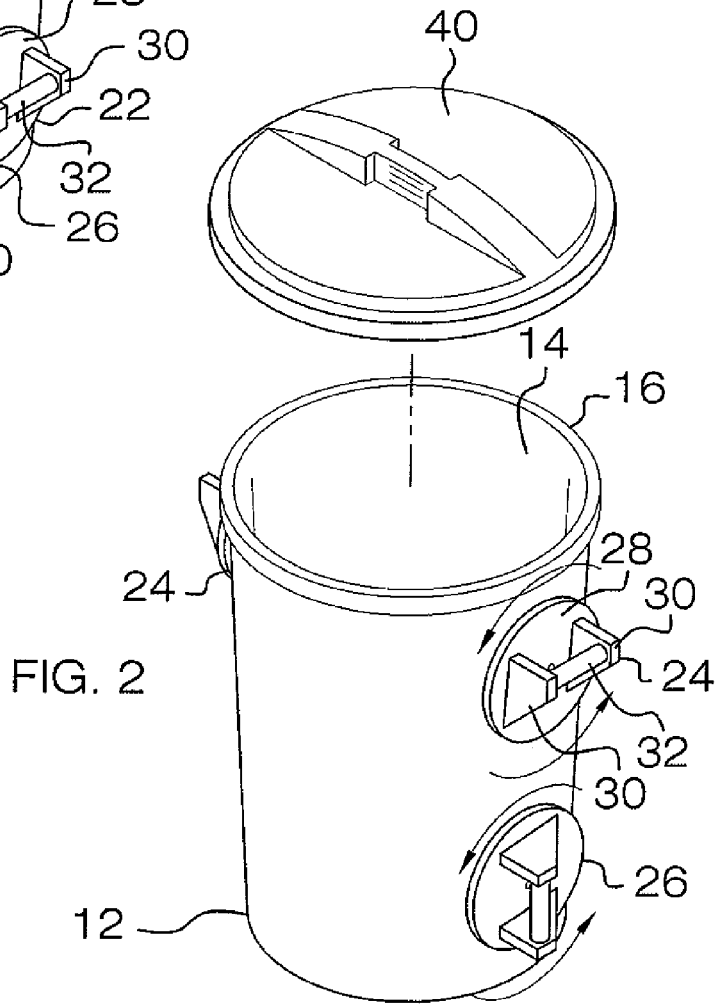
FIG. 2 is an exploded perspective view of the present invention.
Figure 3:
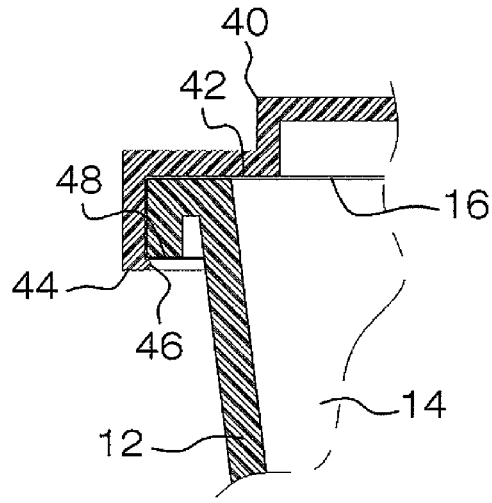
FIG. 3 is a cross-sectional view of the present invention taken along line 3-3 of FIG. 1.
Figure 4:
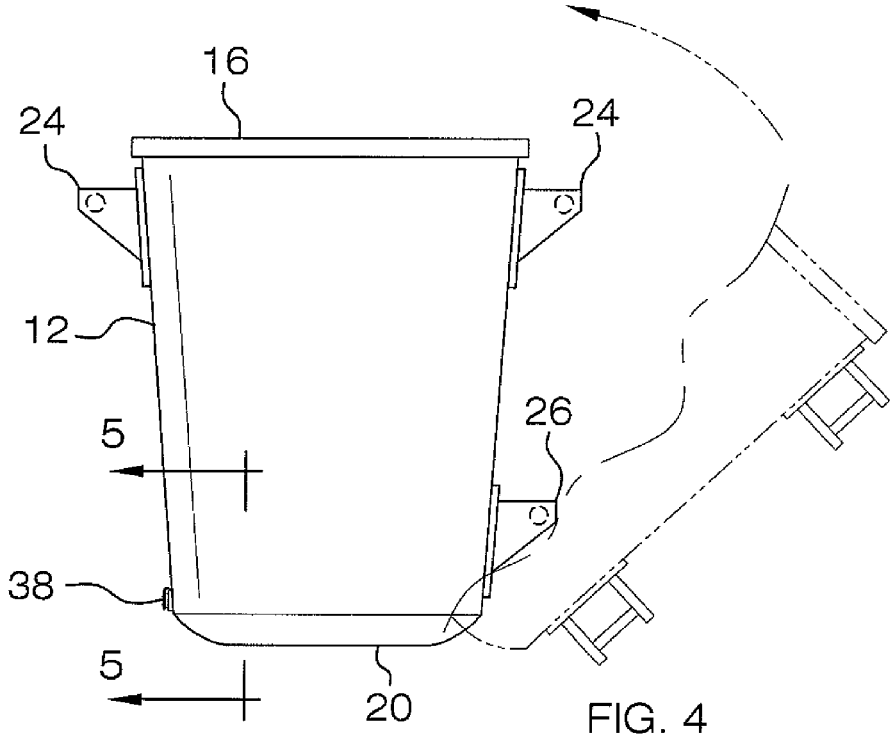
FIG. 4 is a side view of the present invention showing the present invention righting itself from a tipped position.
Figure 5:
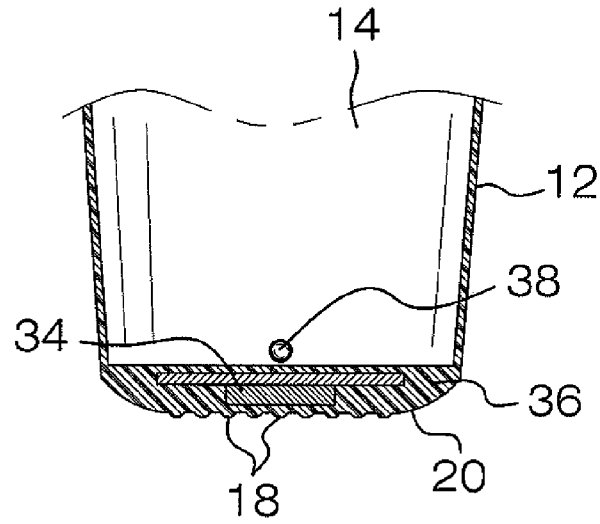
FIG. 5 is a cross-section view of the present invention taken along line 5-5 of FIG. 4.
Figure 6:
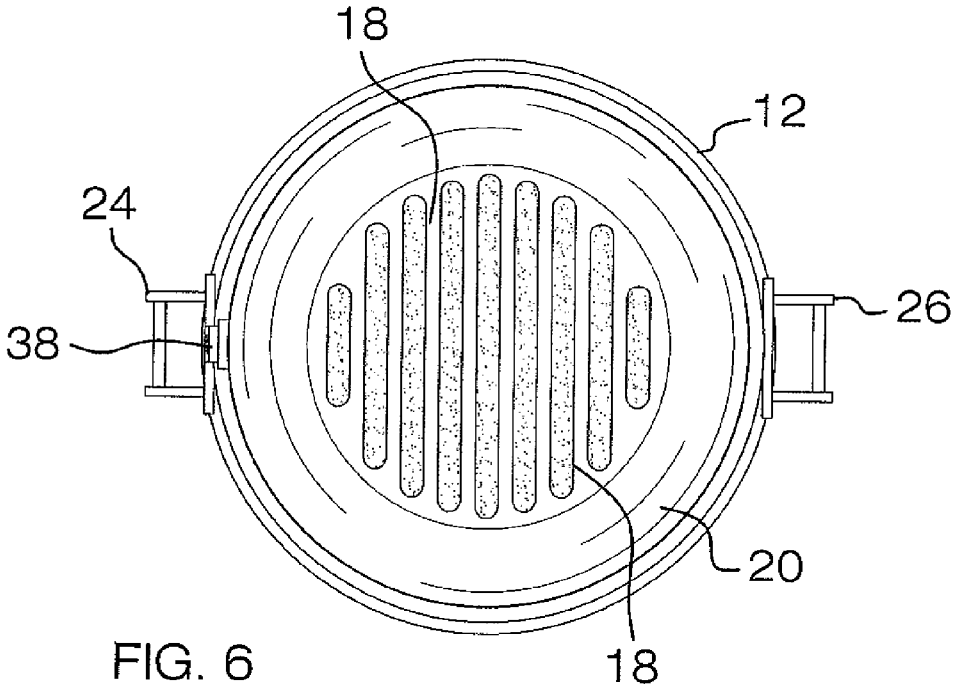
FIG. 6 is a bottom view of the present invention.
Figure 7:
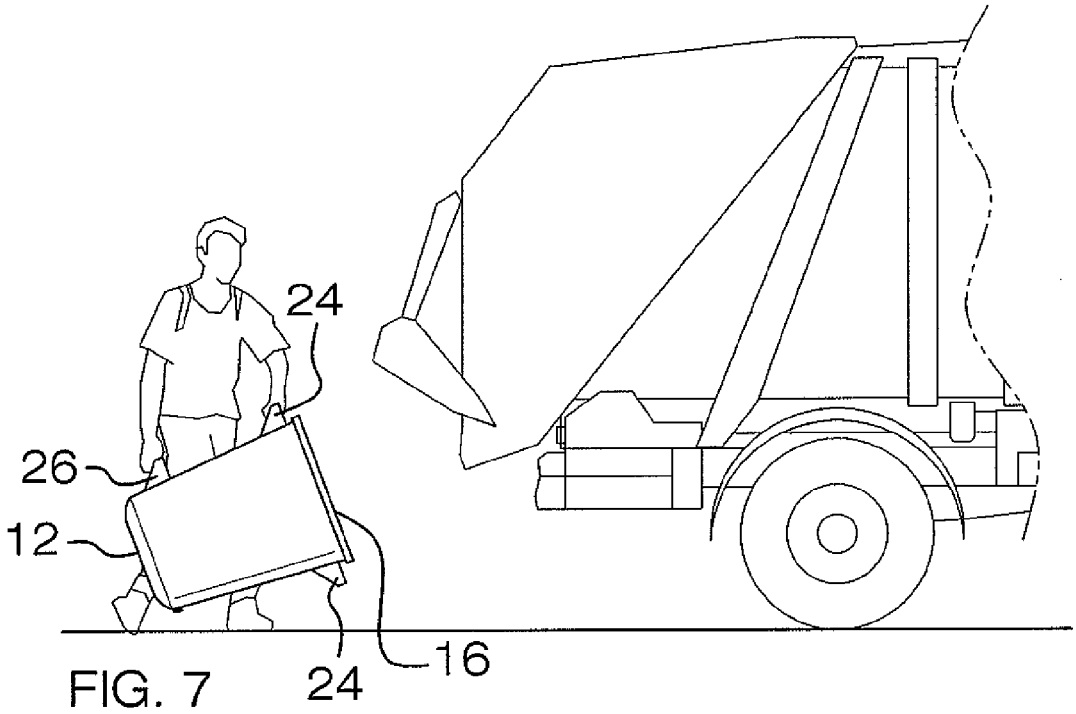
FIG. 7 is a side view of the present invention shown in use.
Figure 8:
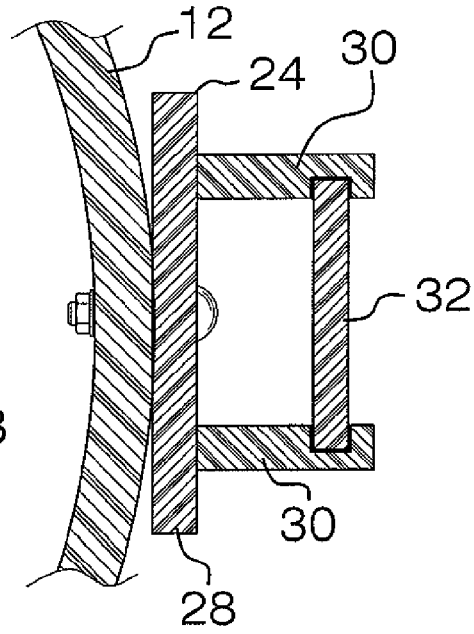
FIG. 8 is a cross-sectional view of the present invention taken along line 8-8 of FIG. 1.

With reference now to the drawings, and in particular to FIGS. 1 through 8 thereof, a new garbage pail embodying the principles and concepts of the present invention and generally designated by the reference numeral 10 will be described.

As best illustrated in FIGS. 1 through 8, the refuse container system 10 generally comprises a container 12 having a cavity 14 extending into the container 12 through a top end 16 thereof. The cavity 14 receives refuse to be disposed of. The container 12 includes a plurality of ridges 18 extending across of portion of a bottom face 20 of the container 12. The ridges 18 enhance frictional contact of the container 12 with a support surface when the container 12 is positioned on the support surface.

A plurality of handles 22 is rotatably mounted to the container 12 to permit each of the handles 22 to be rotated to a desired position. The handles 22 are graspable to facilitate lifting of the container 12. The handles 22 include a pair of upper handles 24 positioned adjacent the top end 16 of the container 12. The upper handles 24 are positioned diametrically opposite one another. The handles 22 include a lower handle 26 positioned adjacent the bottom face 20 of the container 12. The lower handle 26 is vertically aligned with one of the upper handles 24.

Each of the handles 22 includes a base plate 28 rotatably mounted to the container 12. Each of a pair of stanchions 30 is coupled to and outwardly extending from the base plate 28. A gripping bar 32 is coupled to and extends between the stanchions 30. The gripping bar 32 is positioned in a spaced relationship from the base plate 28 to permit grasping of the gripping bar 32 when the container 12 is to be lifted.

A weight 34 is positioned in a bottom wall 36 of the container 12. The weight 34 weighs the container 12 to keep the container 12 in vertical orientation and inhibit inadvertent tipping of the container 12. A drain plug 38 is coupled to the container 12 and is in fluid communication with the cavity 14 of the container 12. The drain plug 38 is actuated to permit liquid in the cavity 14 to drain out of the container 12. The drain plug 38 is positioned adjacent the bottom wall 36.

A lid 40 is positionable over the top end 16 of the container 12 to selectively close the top end 16 and retain the refuse in the cavity 14. The lid 40 has a recess 42 extending into the lid 40 through a lower face 44 thereof. The recess 42 receives the top end 16 of the container 12 when the lid 40 is positioned over the top end 16. The lid 40 includes a lip 46 positioned adjacent the lower face 44 and extending into the recess 42. The lip 46 is positioned under a shoulder 48 of the container 12 positioned adjacent the top end 16 of the container 12 to inhibit inadvertent removal of the lid 40 from the container 12.

In use, the lid 40 is removed from the top end 16 of the container 12 when the refuse is to be disposed of. The upper handles 24 are left in an approximately horizontal position to allow the container 12 to be lifted from the top end 16 of the container 12. The lower handle 26 and the one of the upper handles 24 vertically aligned with the lower handle 26 may be turned to an approximately vertical position to facilitate lifting and carrying of the container 12 from a side of the container 12 especially when the refuse is being dumped from the container 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refuse container system for receiving refuse to be disposed of, said system comprising:

a container having a cavity extending into said container through a top end thereof, said cavity receiving the refuse to be disposed of;

a plurality of handles being rotatably mounted to said container to permit each of said handles to be independently rotated to desired position, said handles being graspable to facilitate lifting of said container, each of said handles including;

a base plate being mounted to said container, wherein said base plate is rotatable, after mounting, to a plurality of orientations to facilitate lifting of said container;

a grip attached to said base plate; and a lid being positionable over said top end of said container to selectively close said top end and retain the refuse in said cavity.

2. The system according to claim 1, wherein said container includes a plurality of ridges extending across of portion of a bottom face of said container, said ridges enhancing frictional contact of said container with a support surface when said container is positioned on the support surface.

3. The system according to claim 1, wherein said handles include a pair of upper handles being positioned adjacent said top end of said container, said upper handles being positioned diametrically opposite one another.

4. The system according to claim 3, wherein said handles include a lower handle being positioned adjacent a bottom face of said container, said lower handle being vertically aligned with one of said upper handles.

5. The system according to claim 1, wherein said grip includes a pair of stanchions being coupled to and outwardly extending from said base plate and a gripping bar being coupled to and extending between said stanchions, said gripping bar being positioned in a spaced relationship from said base plate to permit grasping of said gripping bar when said container is to be lifted.

6. The system according to claim 1, further comprising a weight being positioned in a bottom wall of said container, said weight weighting said container to keep said container in vertical orientation and inhibit inadvertent tipping of said container.

7. The system according to claim 1, further comprising a drain plug being coupled to said container and being in fluid communication with said cavity of said container, said drain plug being actuated to permit liquid in said cavity to drain out of said container.

8. The system according to claim 1, wherein said lid has a recess extending into said lid through a lower face thereof, said recess receiving said top end of said container when said lid is positioned over said top end.

9. The system according to claim 8, wherein said lid includes a lip being positioned adjacent said lower face and extending into said recess, said lip being positioned under a shoulder of said container positioned adjacent said top end of said container to inhibit inadvertent removal of said lid from said container.

10. A refuse container system for receiving refuse to be disposed of, said system comprising:

a container having a cavity extending into said container through a top end thereof, said cavity receiving the refuse to be disposed of, said container including a plurality of ridges extending across of portion of a bottom face of said container, said ridges enhancing frictional contact of said container with a support surface when said container is positioned on the support surface;

a plurality of handles being rotatably mounted to said container to permit each of said handles to be rotated to desired position, said handles being graspable to facilitate lifting of said container, said handles including a pair of upper handles being positioned adjacent said top end of said container, said upper handles being positioned diametrically opposite one another, said handles including a lower handle being positioned adjacent said bottom face of said container, said lower handle being vertically aligned with one of said upper handles, each of said handles comprising;

a base plate being mounted to said container, wherein said base plate is rotatable, after mounting, to a plurality of orientations to facilitate lifting of said container;

a pair of stanchions being coupled to and outwardly extending from said base plate;

a gripping bar being coupled to and extending between said stanchions, said gripping bar being positioned in a spaced relationship from said base plate to permit grasping of said gripping bar when said container is to be lifted;

a weight being positioned in a bottom wall of said container, said weight weighting said container to keep said container in vertical orientation and inhibit inadvertent tipping of said container;

a drain plug being coupled to said container and being in fluid communication with said cavity of said container, said drain plug being actuated to permit liquid in said cavity to drain out of said container, said drain plug being positioned adjacent said bottom wall; and a lid being positionable over said top end of said container to selectively close said top end and retain the refuse in said cavity, said lid having a recess extending into said lid through a lower face thereof, said recess receiving said top end of said container when said lid is positioned over said top end, said lid including a lip being positioned adjacent said lower face and extending into said recess, said lip being positioned under a shoulder of said container positioned adjacent said top end of said container to inhibit inadvertent removal of said lid from said container.

* * * * *